US005266131A

United States Patent [19]

Foster et al.

[11] Patent Number: 5,266,131

[45] Date of Patent: Nov. 30, 1993

[54] ZIRLO ALLOY FOR REACTOR COMPONENT USED IN HIGH TEMPERATURE AQUEOUS ENVIRONMENT

[75] Inventors: John P. Foster, Monroeville; Pamela M. Stevenson, Pittsburgh, both of Pa.

[73] Assignee: Westinghouse Electric Corp., Pittsburgh, Pa.

[21] Appl. No.: 847,513

[22] Filed: Mar. 6, 1992

[51] Int. Cl.[5] ..... C22C 16/00

[52] U.S. Cl. ..... 148/672; 420/422

[58] Field of Search ..... 148/672; 420/422

[56] References Cited

U.S. PATENT DOCUMENTS

| | | | |
|---|---|---|---|
| 3,341,373 | 9/1967 | Evans et al. | 148/12.7 |
| 3,865,635 | 2/1975 | Hofvenstam et al. | 148/11.5 |
| 4,065,328 | 12/1977 | Cheadle | 148/12.7 |
| 4,094,706 | 6/1978 | Schulson et al. | 148/11.5 |
| 4,360,389 | 11/1982 | Urquhart | 148/11.5 |
| 4,450,016 | 5/1984 | Vesterlund et al. | 148/11.5 |
| 4,452,648 | 6/1984 | Cheadle et al. | 148/11.5 |
| 4,584,030 | 4/1986 | McDonald et al. | 148/11.5 |
| 4,649,023 | 3/1987 | Sabol et al. | 420/422 |
| 4,981,527 | 1/1991 | Charquet | 148/672 |
| 5,112,573 | 5/1992 | Foster et al. | 420/422 |

FOREIGN PATENT DOCUMENTS

| | | | |
|---|---|---|---|
| 705863 | 3/1965 | Canada | 148/30 |

OTHER PUBLICATIONS

W. A. Backofen, Deformation Processing, Addison-Wesley Publishing Company, 1972, pp. 85-86.

W. F. Hosford and R. M. Caddell, Metal Forming Mechanics and Metallurgy, Prentice-Hall, 1983, pp. 277-279.

K. L. Murty, "Application of Crystallographic Textures of Zirconium Alloys in the Nuclear Industry", Zirconium in the Nuclear Industry: Eight International Symposium, ASTM STP 1023, American Society for Testing and Materials, Philadelphia, 1989, pp. 570-595.

*Primary Examiner*—Upendra Roy

[57] ABSTRACT

A Zirlo alloy formed by beta quenching, hot deforming, recrystallize annealing and then cold deforming said alloy a plurality of times with recrystallize anneal steps performed between the cold deforming steps followed by stress relief annealing. The fabricating method can include a late stage beta quench step in place of one of the recrystallize anneal steps.

2 Claims, 3 Drawing Sheets

ZIRLO ALLOY FOR REACTOR COMPONENT USED IN HIGH TEMPERATURE AQUEOUS ENVIRONMENT

BACKGROUND OF THE INVENTION

1. Field of the Invention

This invention relates to a Zirlo alloy and to a method for fabricating a Zirlo alloy in tubes or strips. Zirlo is used in the elevated temperature aqueous environment of a reactor of a nuclear plant and is an alloy of primarily zirconium containing nominally by weight 1 percent niobium, 1 percent tin and 0.1 percent iron. Generally, Zirlo comprises 0.5 to 2.0 weight percent niobium, 0.7 to 1.5 weight percent tin and 0.07 to 0.28 of at least one of iron, nickel and chromium and up to 200 ppm carbon. The balance of the alloy comprises essentially zirconium.

2. Background of the Invention

Among the objectives of fabrication methods for Zirlo are obtaining good corrosion resistance with acceptable texture. The relationship between pilger reduction formability and texture parameters are presented below by first describing the formability parameter and then showing the applicability of the formability parameter to pilger reduction.

The formability parameter describes the small and large strain behavior of anisotropic materials such as Zirlo. W. A. Backofen, Deformation Processing, Addison-Wesley Publishing Company, 1972, pp. 85–86. defined the formability parameter B to describe the distortion or anisotropy of the yield locus. Backofen defined the formability parameter as $$B=\sigma_I/2\,\sigma_{IV}$$

where $\sigma_I$ is the maximum stress in quadrant I and $\sigma_{IV}$ represents the shear stress in quadrant IV of the yield locus. The B parameter is important because the higher the B value, the better the material formability. Although the yield behavior is associated with small strains, the formability parameter also describes high strain metalworking operations. For deep cup drawing, the drawing limit is given by the limiting drawing ratio, LDR $$ln(LDR)=\sigma_w/\sigma_f$$

where $\sigma$ is the stress and the subscripts w and f denote the cup wall and flange, respectively. W. F. Hosford and R. M. Caddell, Metal Forming Mechanics and Metallurgy, Prentice-Hall, 1983, pp. 277–279, have shown for deep cup drawing that the formability parameter is related to the LDR according to the equation $$B=ln(LDR)$$

Hence, the formability parameter describes deep cup drawing.

Pilger reduction and deep cup drawing are considered to be related processes based on the similarity between the stresses and strains developed during pilgering and deep cup drawing. Pilgering is a direct compression metalworking operation. A force is applied to the tubeshell surface by the die and metal flows at right angles to the applied force. In the case of deep cup drawing, the applied force is tensile, but large compressive forces are developed by the reaction of the workpiece and the die. More specifically, as the metal is inwardly drawn, the outer circumference continually decreases. This means that in the flange region the workpiece is subject to compressive hoop strain and stress. Hence both pilgering and deep cup drawing may be considered to be similar metalworking operations because they both involve large compressive strain and stress.

The texture of anisotropic tubes is characterized by the transverse contractile strain ratios. The transverse contractile strain ratios of an anisotropic tube define the resistance to wall thinning. The transverse contractile strain ratios are $$R=\Delta e_\theta/\Delta e_r \text{ for } \sigma_\theta=\sigma_r=0$$

$$P=\Delta e_z/\Delta e_r \text{ for } \sigma_z=\sigma_r=0$$

where $\theta$, z and r are the hoop, axial and radial directions. K. L. Murty, "Application of Crystallographic Textures of Zirconium alloys in the Nuclear Industry", Zirconium in the Nuclear Industry: Eight International Symposium, ASTM STP 1023, American Society for Testing and Materials, Philadelphia, 1989, pp. 570–595, has developed the relationship between the formability parameter and the contractile strain ratios R and P. The relationship is $$B=[\{(R+1)(R+4RP+P)\}/\{4R(R+P+1)\}]^{0.5}$$

A pilger reduction operation is considered successful when a defect free tube is produced. The production of a defect free tubeshell depends on whether the hoop and/or axial stress remains below the tensile strength of the metal near the ID surface. When the hoop and/or axial stress exceeds the tensile strength of the metal near the tubeshell ID surface, the tubeshell develops small tears or microfissures. Presumably, an increase in the formability parameter is associated with a decrease in the tendency for microfissure development.

SUMMARY OF THE INVENTION

In accordance with this invention, improved Zirlo formability may be obtained by fabricating Zirlo employing higher recrystallization temperatures than have been employed heretofore.

Zirlo strip material was processed according to the schematic process outline presented in FIG. 1, discussed in more detail below. The recrystallization anneals were performed at temperatures of 1100° F. (593° C.), 1250° F. (677° C.) and 1350° F. (732° C.), respectively. Longitudinal and transverse direction uniaxial tensile samples were cut from the strip and tested to measure the transverse contractile strain ratio parameters R and P. In a uniaxial strip sample, the transverse contractile strain ratios are $$R=\Delta e_t/\Delta e_n \text{ for } \sigma_n=\sigma_t=0$$

$$P=\Delta e_r/\Delta e_n \text{ for } \sigma_n=\sigma_r=0$$

where r, n and t denote the rolling, normal and transverse directions of the strip, respectively.

Figure 1:
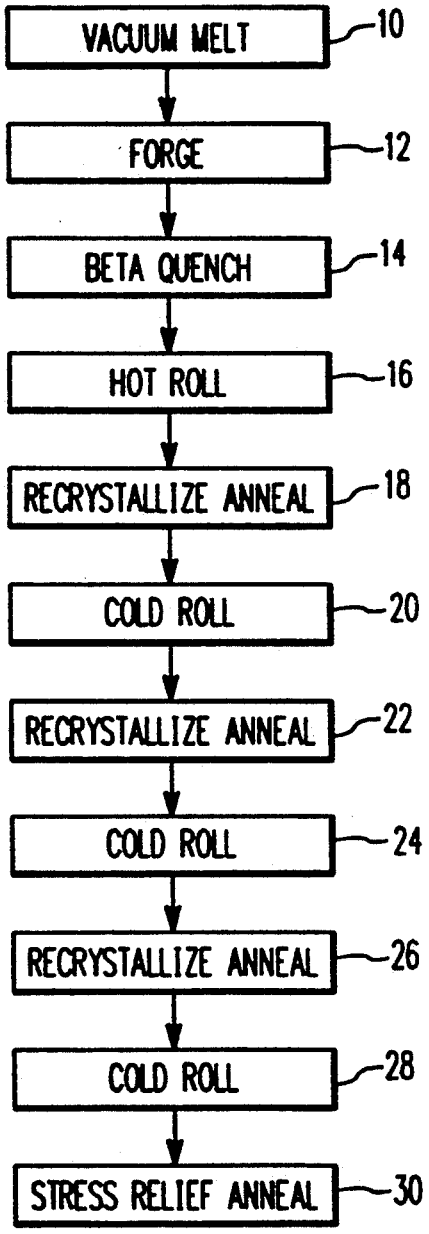
FIG. 1 shows a sequence of steps for forming Zirlo strip.

We have found that use of a recrystallization anneal temperature higher than those employed heretofore in the process scheme of FIG. 1 increases formability or fabricability. Table 1 shows for the uniaxial strip samples that a recrystallization anneal temperature within the range of this invention increases the formability parameter B.

TABLE 1

| Uniaxial Strip Sample Transverse Contractile Strain Ratio Data and Calculated Formability Parameters | | | |
|---|---|---|---|
| Recrystallization Anneal Temperature (°F.) | R | P | B |
| 1100 (593° C.) | 2.6 | 2.7 | 1.4 |
| 1250 (677° C.) | 5.3 | 5.4 | 1.8 |
| 1350 (732° C.) | 3.4 | 5.0 | 1.6 |

Similar results have been observed during tube fabrication.

Table 2 shows that the percentage of tubes accepted (tubes with flaws less than the ultrasonic defect standard) increase with increasing intermediate recrystallization temperature.

TABLE 2

| Tube Ultrasonic Flaw Acceptance Data | |
|---|---|
| Intermediate Recrystallization Anneal Temperature (°F.) | Acceptance (%) |
| 1100 (593° C.) | 93 |
| 1250 (677° C.) | 98 |

Therefore, an increase in formability decreases defect development during tube reduction.

Figure 3:
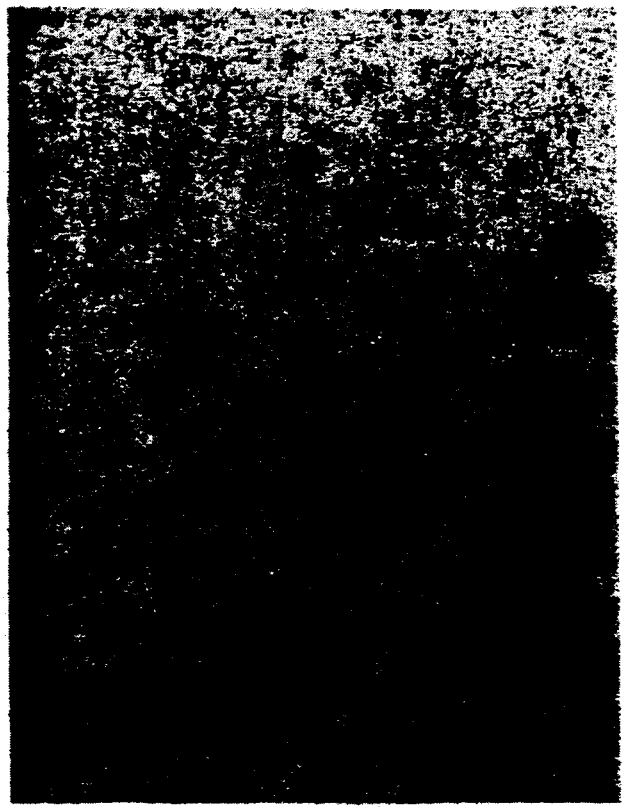
FIGS. 3, 4 and 5 show photomicrographs of Zirlo fabricated at various temperatures.
Figure 4:
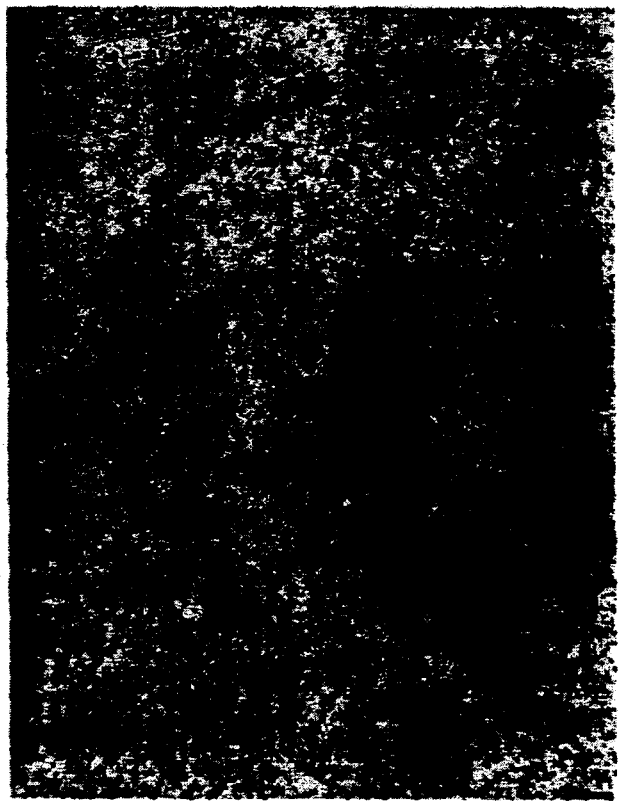
Figure 5:
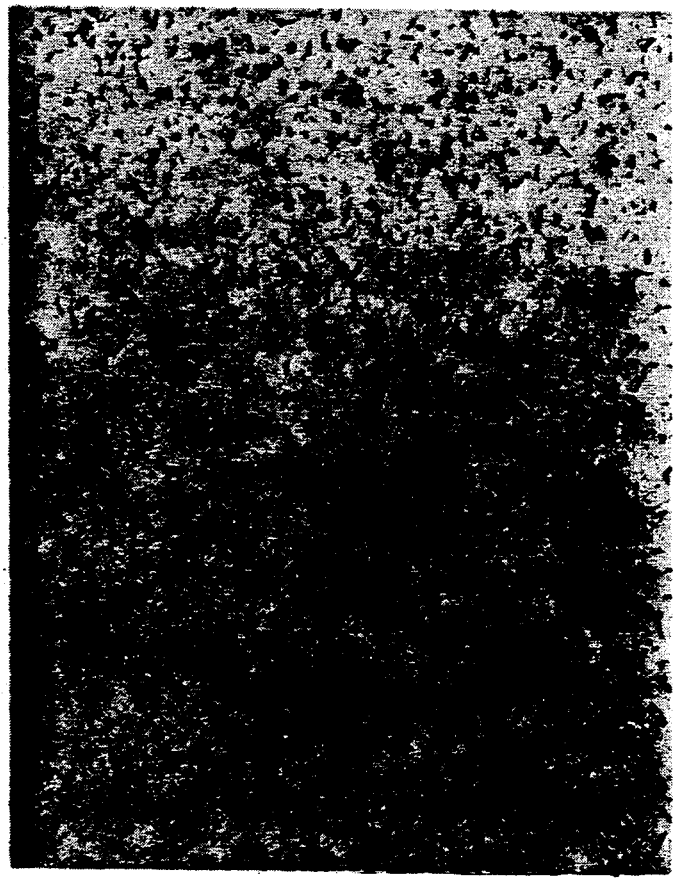

The observed increase in the formability parameter with intermediate anneal temperature may be due to microstructural changes as well as texture changes. The photomicrographs of FIGS. 3, 4 and 5 in 500× magnification show the microstructure for intermediate anneal temperatures of 1100°, 1250° and 1350° F. (593°, 677° and 732° C.), respectively. At 1100° F. (593° C.), the second phase is uniformly distributed (see FIG. 3). However, at 1250° F. (677° C.) the precipitate size increases with large amounts located at grain boundaries (see FIG. 4). FIG. 5 shows that at 1350° F. (732° C.) the second phase precipitate size increased and almost all of the second phase is located at the grain boundaries. The coarse second phase particle distribution associated with intermediate anneal temperatures of 1250° F. (677° C.) and 1350° F. (732° C.) could exhibit reduced inreactor corrosion resistance. A fine second phase particle distribution may be obtained by performing a late stage beta anneal and water quench after processing the materials with intermediate anneal temperatures above 1100° F. (593° C.). As shown in Table 3, the late stage beta quench will also slightly improve corrosion resistance.

TABLE 3

| Corrosion Improvement Due To Beta-Quenching The Tubeshells During Tube Reduction Two Steps Prior To Final Size | | |
|---|---|---|
| Beta-Quench | Intermediate Anneal Temperature (°F.) | 750° F. Steam Corrosion Rate (mg/dm$^2$ – d) |
| No | 1100 (593° C.) | 1.03 |
| Yes | 1100 (593° C.) | 0.92 |
| No | 1170 (632° C.) | 1.01 |
| Yes | 1170 (632° C.) | 0.90 |

Out-of-reactor autoclave tests suggest similar corrosion behavior for material processed with intermediate anneal temperatures between 1100° F. (593° C.) and 1350° F. (732° C.). Table 4 shows that the corrosion rates for 750° F. (371° C.) and 968° F. (520° C.) steam are similar.

TABLE 4

| Corrosion Rates | | | |
|---|---|---|---|
| Corrosion Test | Test Time (d) | Intermediate Anneal Temperature (°F.) | Corrosion Rate mg/dm$^2$ – d |
| 750° F. steam | 252 | 1100 (593° C.) | 2.03 |
| | | 1250 (677° C.) | 1.74 |
| | | 1350 (732° C.) | 1.60 |
| 968° F. steam | 15 | 1100 (593° C.) | 39.5 |
| | | 1250 (677° C.) | 37.4 |
| | | 1350 (732° C.) | 38.3 |

As shown in Table 4, the material processed with intermediate anneal temperatures of 1250° F. (677° C.) and 1350° F. (732° C.) exhibited slightly lower 750° F. (371° C.) and 968° F. (520° C.) steam corrosion rates than material processed at 1100° F. (593° C.).

DETAILED DESCRIPTION OF THE PREFERRED EMBODIMENT

A sequence of steps for working a plate of Zirlo metal is shown in FIG. 1 where 10 indicates vacuum melting of a Zirlo ingot followed by forging at step 12 to produce a billet and beta quenching said billet at step 14. Beta quench step 14 occurs at a temperature of about 2000° F. (1093° C.) and accomplishes an improved dispersion of alloying metals in the zirconium. Beta quench step 14 is followed by hot deforming or roll step 16 which occurs at a temperature of about 1060° F. and accomplishes about a 70 percent reduction which in turn is followed by recrystallize anneal step 18 which occurs at a temperature of about 1100° F. Then follows a plurality of recrystallize anneal cold roll combination steps 18 and 20, 22 and 24 and 26 and 28. Recrystallize anneal steps 18, 22 and 26 are performed at a temperature of 1200° to 1400° F. (649° to 760° C.) generally, and 1230° to 1270° F. (666° to 688° C.), preferably. The cold roll steps 20, 24 and 28 accomplish about a 30% reduction. Although two such combination cold deform or roll and recrystallize anneal steps are shown, additional such combination steps can be employed. Finally, the plate is stress relief annealed at step 30 at a temperature of about 870° F.

Figure 2:
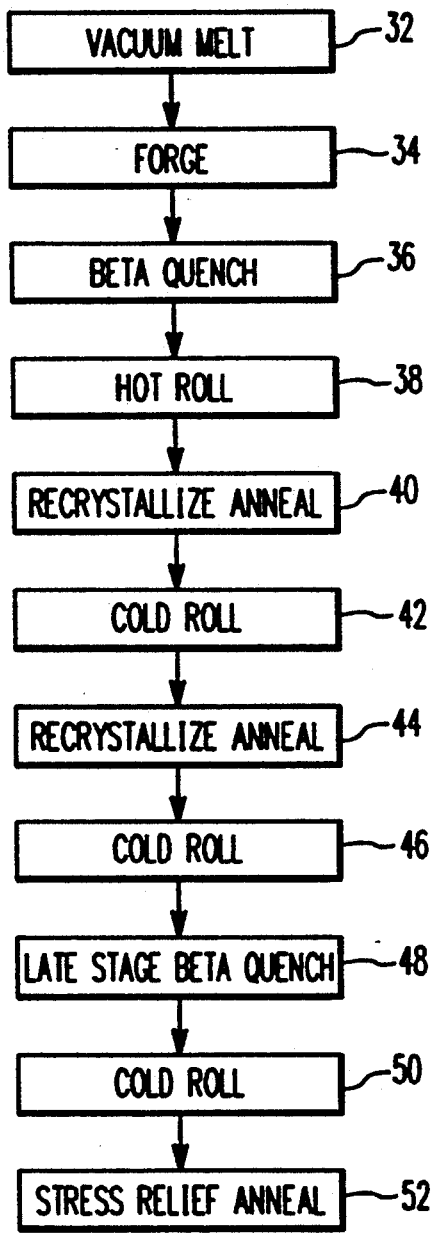
FIG. 2 shows a modified sequence of steps for forming Zirlo strip.

A more preferred sequence of steps for working a plate of Zirlo metal is shown in FIG. 2 where 32 indicates vacuum melting of Zirlo ingot followed by forging step 34 and beta quench step 36. Beta quench step 36 of a billet of the alloy occurs at a temperature of about 2000° F. and accomplishes an improved dispersion of alloying metals in the zirconium. Beta quench step 36 is followed by hot roll step 38 which occurs at a temperature of about 1060° F. and which accomplishes about a 70 percent reduction. Then follows two recrystallization anneal and cold work steps 40 and 42, and 44 and 46. Recrystallize anneal steps 40 and 44 are performed at a temperature of 1200° to 1400° F., and preferably at a temperature of 1230° to 1270° F. The cold roll steps 42 and 46 accomplish about a 30% reduction. Then follows late stage beta quench step 48 which occurs at a higher temperature of about 2000° F. The operation is concluded by cold roll step 50 which accomplishes about a 30 percent reduction and finally by stress relief anneal step 52 which occurs at about 870° F.

We claim:

1. An article of manufacture for use in the elevated temperature aqueous environment of a reactor of a nuclear plant, said article comprising:

a zirconium alloy comprising:

0.5 to 2.0 weight percent niobium, 0.7 to 1.5 weight percent tin, 0.07 to 0.28 weight percent of at least one of iron, nickel and chromium, up to 200 ppm carbon, and the balance of said alloy consisting essentially of zirconium, said article produced by subjecting the material to a plurality of recrystallization anneal and cold work combination steps and a late stage beta quench step, the recrystallization anneal steps being performed at a temperature of 1200° to 1400° F. and the late stage beta quench step being performed at a temperature of about 2000° F.

2. The article of manufacture of claim 1 wherein said recrystallization anneal steps are performed at a temperature of 1230° to 1270° F.

* * * * *